US005549513A

United States Patent [19]

Thomas et al.

[11] Patent Number: 5,549,513

[45] Date of Patent: Aug. 27, 1996

[54] ROOF VENTILATION DEVICE

[75] Inventors: John F. Thomas, Villa Park; Anthony F. Gillett, Orange, both of Calif.

[73] Assignee: Monier Roof Tile Inc., Irvine, Calif.

[21] Appl. No.: 136,313

[22] Filed: Oct. 13, 1993

[51] Int. Cl.[6] ..... F24F 7/02

[52] U.S. Cl. ..... 454/365; 52/199; 454/366

[58] Field of Search ..... 52/57, 199; 454/364, 454/365, 366, 367, 339, 341, 356, 368

[56] References Cited

U.S. PATENT DOCUMENTS

| | | | |
|---|---|---|---|
| 938,930 | 11/1909 | Wiest | 52/553 |
| 1,381,630 | 6/1921 | Goodrich | 454/366 X |
| 2,905,072 | 9/1959 | Oswald | 52/553 |
| 4,498,267 | 2/1985 | Beck | 52/57 X |
| 4,899,505 | 2/1990 | Williamson et al. | 52/199 |

FOREIGN PATENT DOCUMENTS

| | | | |
|---|---|---|---|
| 2476722 | 8/1981 | France . | |
| 2687181 | 8/1993 | France . | |
| 9000176 | 8/1941 | Netherlands | 454/366 |
| 593645 | 10/1947 | United Kingdom . | |
| 1336505 | 11/1973 | United Kingdom . | |
| 1393977 | 5/1975 | United Kingdom . | |
| 1591627 | 6/1981 | United Kingdom . | |
| 2145131 | 6/1986 | United Kingdom . | |
| 2199860 | 7/1988 | United Kingdom | 454/366 |
| 2236775 | 4/1991 | United Kingdom . | |
| 2262295 | 6/1993 | United Kingdom . | |
| 2262949 | 7/1993 | United Kingdom . | |
| 2271585 | 4/1994 | United Kingdom . | |

*Primary Examiner*—Harold Joyce
*Attorney, Agent, or Firm*—Loeb & Loeb LLP

[57] ABSTRACT

A roof structure, which has a plurality of concrete tiles arranged in overlapping rows on a roof support structure, is provided with a roof ventilation device for venting the underside of the roof support structure. The device receives and integrates with a plurality of shortened tiles in an upper row so as not to disturb the appearance and continuity of the roof structure. A hollow upper portion of the roof ventilation device forms part of a ventilation path which extends from outside the roof structure to one or more apertures in the roof support structure and has a plurality of baffles disposed therein for preventing entry of rain water. A length of mesh mounted within an inside portion of the roof ventilation device at the back of the upper portion prevents entry of insects, vermin and debris, while foam strips mounted on the mesh seal the space above tiles in a lower row. A rear portion of the roof ventilation device, which receives the lower edges of the upper row of tiles, includes clips for engaging the side edges of such tiles to hold the lower portions thereof in place. A plurality of spaced apart legs extend downwardly from the rear portion into contact with the roof support structure, and extend forwardly into contact with the upper edges of a lower row of tiles.

19 Claims, 13 Drawing Sheets

ROOF VENTILATION DEVICE

BACKGROUND OF THE INVENTION

1. Field of the Invention

The present invention relates to roof ventilation devices for venting the underside of a roof structure to the outside thereabove.

2. History of the Prior Art

It is well known in the construction of roof structures to provide such structures with ventilation arrangements so that the underside thereof is vented to the atmosphere above. Such venting prevents the unwanted accumulation of moisture at the underside of the roof structure and other undesirable effects which may occur in the event the roof structure is left unvented.

Desirably, a ventilation air flow path is established between eave vents at the lower edges of the roof and ridge vents located adjacent the peak of the roof and within the attic space below the roof. Wind blowing across the roof creates a vacuum or venturi effect to draw air through the eave vents and force air out of the ridge vents. With no wind, ventilation still occurs as warm air rises within the attic space and exhausts through the ridge vents, thereby drawing fresh air through the eave vents.

In typical prior art arrangements for venting roof structures, the roof support structure on which a plurality of tiles or shingles are mounted is provided with one or more apertures to vent the space therebelow. The apertures are in turn vented to the atmosphere above the roof structure by the use of devices which provide air passages to the outside of the roof from the apertures in the roof support structure.

Examples of prior art roof ventilation devices are provided by U.S. Pat. Nos. 4,899,505 of Williamson et al., 2,905,072 of Oswald, and 938,930 of Wiest, and by U.K. Patent No. 2,145,131, U.K. Patent Application No. 2,199,860 and U.K. Patent Specification No. 593,645. The Wiest patent describes a concrete shingle having spacers and fluid passages which cooperate with apertures in the roof support structure to vent the roof structure. The U.K. '645 patent specification describes a ventilation device disposed between adjacent shingles, while the Oswald patent and the U.K. '860 patent application describe ventilation devices which replace an entire shingle or tile in a wall or roof structure. In Oswald, the ventilation device has moisture drain holes at the bottom thereof as well as a screen to keep out vermin. In the U.K. '860 patent application, a fly screen is employed to keep out insects and vermin, while the Williamson patent describes openings and slots which are configured to keep out rain water. The U.K. '131 patent provides yet another example of a roof ventilation device.

While the various roof ventilation devices described in the patents, applications and specifications noted above function to ventilate the various roof and wall structures thereof, such devices leave much to be desired in terms of their lack of desirable features. One of the main disadvantages of such devices is their inability to integrate with the roof structure in such a way that they form a part of the tiles, shingles or other product of the roof structure. Ideally, the roof ventilation device should integrate with and form a part of the product in a manner which provides effective ventilation while at the same time not disturbing the appearance and continuity of the tiles, shingles or other product forming the upper portion of the roof structure. The roof ventilation device should also be capable of securing adjacent portions of the tiles or shingles in place. In addition to ventilating the roof support structure to the atmosphere above the roof structure in an effective manner, such roof ventilation devices must also be effective in preventing the entry of rain water, insects, vermin and debris into apertures in the roof support structure. Desirably, such devices should be effective in preventing entry of rain water in deluge conditions and when the rain is wind driven such as in severe storm or hurricane conditions.

BRIEF DESCRIPTION OF THE INVENTION

Roof structures in accordance with the invention include a roof support structure having a plurality of rows of tiles mounted thereon, with each of the rows being mounted above an adjacent lower row at a like standard distance therefrom. At least one roof ventilation device is disposed between at least one tile in a first row of the plurality of tile rows and at least one tile in a second row of the plurality of rows which is adjacent and immediately below the first row. The roof ventilation device forms a ventilation path between the at least one tile in the first row and the at least one tile in the second row, with such path extending to the roof support structure. The plurality of rows of tiles are comprised of tiles of like standard length, except for the first row in which the at least one tile thereof has a length shorter than the standard length and terminates in a lower edge which is secured to the roof ventilation device. In this manner, the roof ventilation device integrates with the shortened tiles in the first or upper row to provide effective ventilation of the roof structure without disturbing the appearance and the continuity of the rows of tiles. In effect, the roof ventilation device forms a part of the roof tiles or other roof covering product.

In a typical roof structure according to the invention, a row of the roof ventilation devices is assembled by placing a plurality of the devices end-to-end across a portion of the roof adjacent the peak thereof to form a ridge venting arrangement. A first row of the shortened tiles at the upper side of the roof ventilation devices have their lower ends secured to the devices, while a second row of tiles of standard length have upper edges extending under the devices. The roof ventilation devices form air flow paths which communicate with apertures in the roof support structure beneath the first row of tiles. The apertures are fitted with moisture frames having collars which prevent any water which may accumulate on the roof support structure from entering the apertures. Also, moisture trays may be mounted at the undersides of the first row of tiles above the apertures and the moisture frames to further minimize leakage of water through the tiles and onto the roof support structure.

In a preferred embodiment of a roof ventilation device in accordance with the invention, the device receives the lower edges of two tiles in an upper row of tiles and extends into contact with the upper edges of a plurality of tiles in a lower row of tiles immediately therebelow. The device includes a rear portion for receiving the lower edges of the two tiles of the upper row, a hollow upper portion extending forwardly from the rear portion and a plurality of spaced apart legs extending downwardly from the rear portion and part of the upper portion. The hollow upper portion has a plurality of baffles mounted therein to form a rain barrier. The upper portion has a slot therein extending from the rear portion to an opposite front portion of the device to provide drainage of moisture from the rear portion. An inside portion of the device which extends from the hollow interior of the upper portion to the plurality of spaced apart legs has a mesh element mounted therein to form an insect barrier. Foam strips mounted along a forward portion of the mesh element engage the irregular and slightly curved upper surfaces of the tiles in the lower row to help seal the space therebetween.

The baffles within the hollow upper portion of the roof ventilation device preferably comprise a repeating pattern of arc shaped vanes along the length of the upper portion of the device, with each pattern being comprised of a plurality of arc shaped vanes of decreasing curvature and increasing length.

The rear portion of the roof ventilation device includes a pair of clips for engaging the side edges of the two tiles within the upper row of tiles adjacent the lower edges of such tiles. A second one of the clips is located at an end of the rear portion of the device. Foam strips mounted along a back surface of the hollow upper portion adjacent the rear portion engage the lower front edges of the upper tiles to minimize leakage of water from the upper tiles to the underside of the roof ventilation device.

The rear portion of the roof ventilation device has a plurality of nail holes therein for securing the roof ventilation device to the roof support structure. Each of the nail holes extends through a different one of the plurality of spaced apart legs at the underside of the device.

The roof ventilation device, which is of elongated configuration in a direction across the roof, is generally flat and planar in cases where the device is used with flat tiles. Where the tiles are profiled or of non-flat cross-sectional configuration, the roof ventilation device is similarly profiled so as to interface with such tiles in form fitting fashion.

BRIEF DESCRIPTION OF THE DRAWINGS

The foregoing and other objects, features and advantages of the invention will be apparent from the following more particular description of a preferred embodiment of the invention, as illustrated in the accompanying drawings, in which.

DETAILED DESCRIPTION

Figure 1:
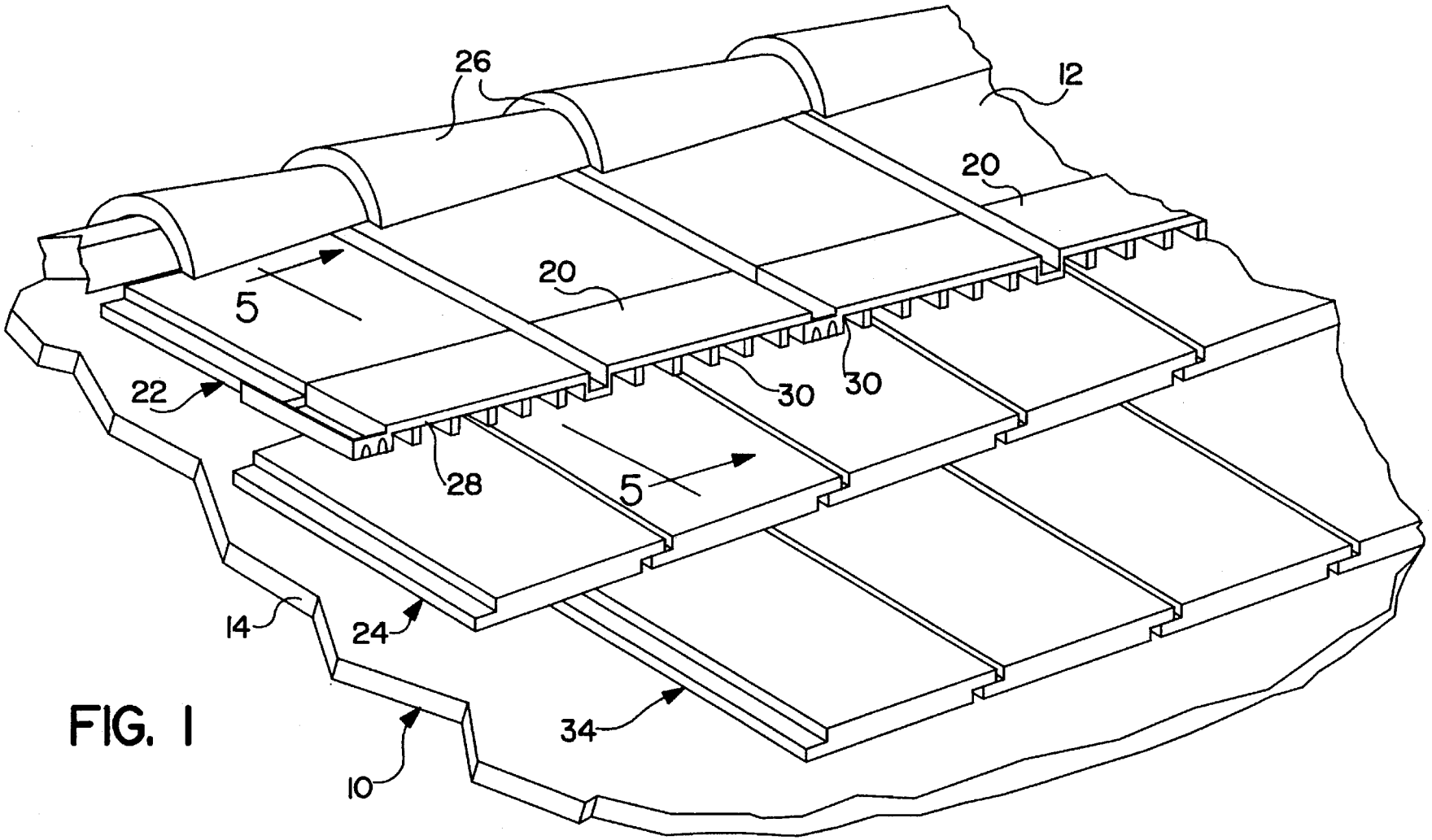
FIG. 1 is a perspective view of a portion of a roof structure including roof ventilation devices in accordance with the invention.

FIG. 1 shows a portion of a roof structure 10 which has a plurality of concrete roof tiles 12 mounted on a roof support structure 14. The tiles 12 may be mounted on the roof support structure 14, either directly or with the aid of battens (not shown), in conventional fashion. Where battens are used, each batten is disposed beneath upper portions of a different row of the tiles 12. The tiles 12 are installed on the roof structure 10 by driving nails or other fasteners through holes in the tiles 12 and into the roof support structure 14, in conventional fashion. The roof support structure 14 is comprised of plywood sheeting or other appropriate decking material covered with tarpaper on other suitable underlayment.

In accordance with the invention, the roof structure 10 of FIG. 1 includes a plurality of roof ventilation devices 20. The roof ventilation devices 20 are integrated into the roof structure 10 between an upper row 22 of the tiles 12, extending to the peak of the roof structure 10, and a next lower row 24 of the tiles 12. The various rows of tiles 12 within the roof structure 10 overlap the tiles of the next lower row, in conventional fashion. However, the roof ventilation devices 20 effectively form the lower portions of the tiles within the upper row of tiles 22 so as to overlap the upper portions of the tiles within the next lower row 24. This is made possible, while at the same time maintaining a standard spacing between the tiles of the upper row 22 and the tiles of the next lower row 24, by using shortened tiles of less than standard tile length in the upper row 22. The tiles 12 in the upper row 22 extend to the peak of the roof structure 10, where they are disposed beneath a row of capping tiles 26.

By mounting the roof ventilation devices 20 in conjunction with the shortened tiles of the upper row 22, the roof ventilation devices 20 are able to vent the underside of the roof structure 10 beneath the roof support structure 14 to the atmosphere above, while at the same time integrating into the roof structure 10 in a manner which does not disturb the appearance and the continuity of the tiles 12. A plurality of the roof ventilation devices 20 are mounted end-to-end to form a row of the devices 20. The row of roof ventilation devices 20 forms a ridge vent for the roof structure 10.

As described in detail hereafter, each of the roof ventilation devices 20 receives and secures thereon the lower edges of two of the tiles 12 within the upper row 22. At the same time, the roof ventilation device 20 has a plurality of spaced apart legs at the underside thereof for assisting in the mounting of the device 20 on the roof support structure 14 between the tiles of the upper row 22 and those of the next lower row 24. A ventilation path is formed in part by a hollow upper portion 28 of each roof ventilation device 20 which extends over the upper edges of the tiles in the next lower row 24. The hollow upper portion 28 communicates with apertures in the roof support structure 14 (shown in FIGS. 2 and 3) to ventilate the underside of the roof support structure 14 to the atmosphere above the tiles 12. The hollow interiors of the upper portions 28 of the roof ventilation devices 20 are provided with arrangements of baffles 30 to prevent rain from being wind driven to or otherwise reaching an inside portion of the devices 20, as described hereafter.

Figure 2:
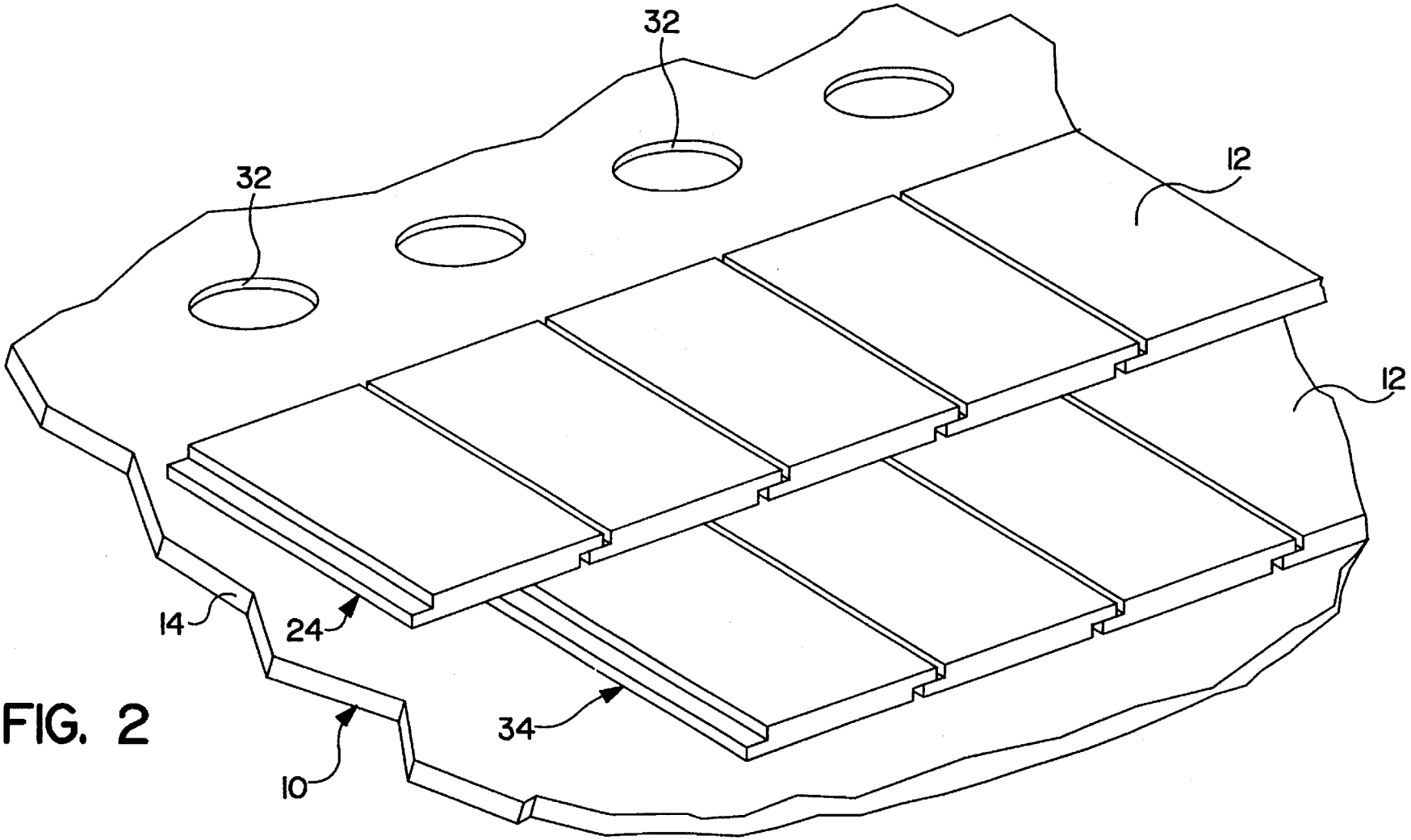
FIG. 2 is a perspective view similar to that of FIG. 1, but with the roof ventilation devices and the uppermost row of tiles removed to show the locations of venting apertures in the roof support structure.

FIG. 2 shows the roof structure 10 with the roof ventilation devices 20 and the upper row 22 of the tiles 12 removed. As seen in FIG. 2, the roof support structure 14 has a different circular aperture 32 formed therein beneath each of the tiles 12 in the upper row 22. Each aperture 32 forms part of a path of air circulation extending from the attic space beneath the roof support structure 14 through a portion of one of the roof ventilation devices 20 to the atmosphere above the roof structure 10.

Figure 3:
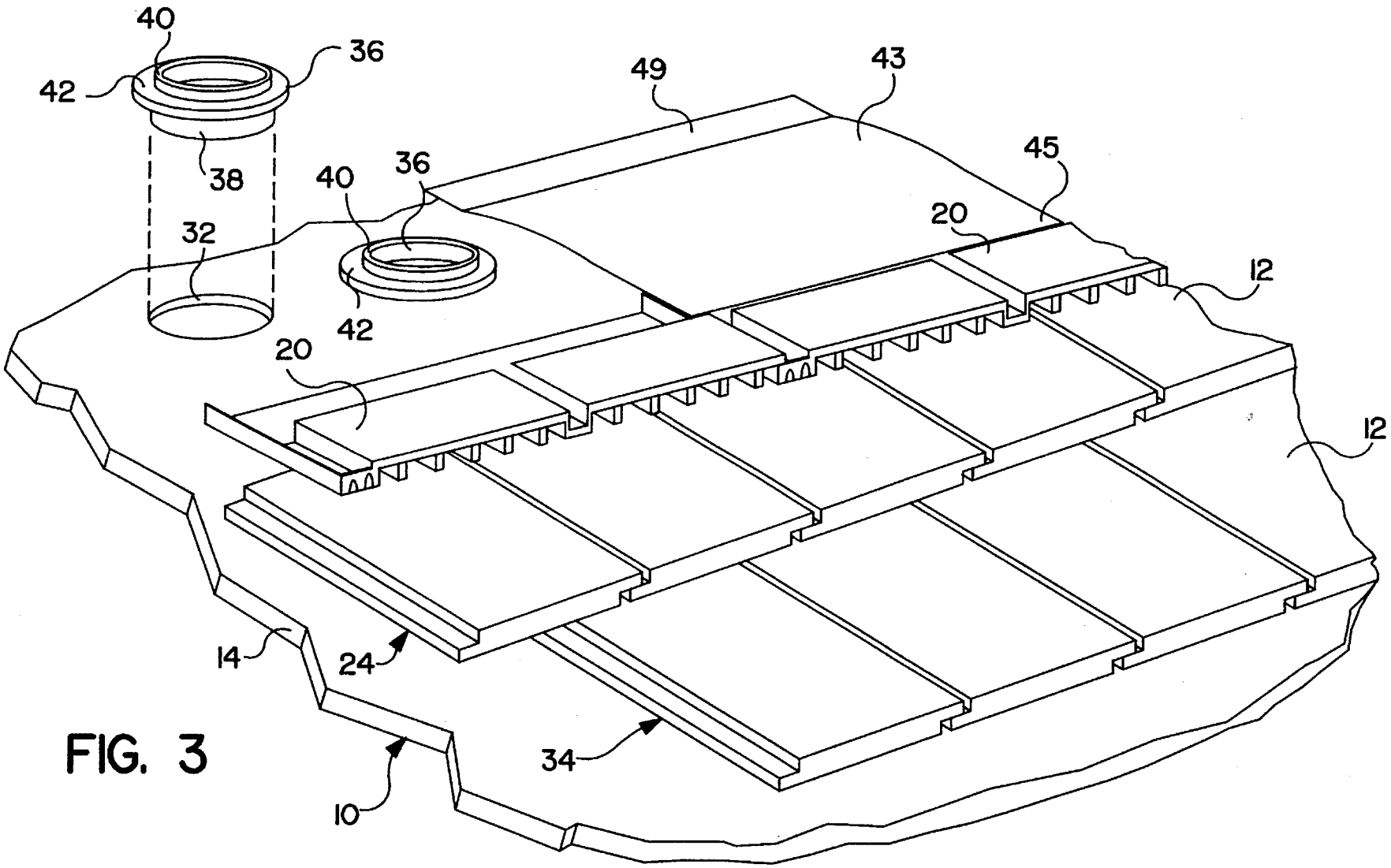
FIG. 3 is a perspective view similar to that of FIG. 1, but with the uppermost row of tiles removed to show the manner in which the apertures of FIG. 2 are fitted with moisture frames and moisture trays are disposed over the apertures and joined to the roof ventilation devices.

During construction of the roof structure 10, the row 24 of the tiles 12 and a row 34 of the tiles 12 below the row 24 are installed on the roof support structure 14, and the apertures 32 are formed in the roof support structure 14, as shown in FIG. 2. The roof ventilation devices 20 are then positioned over the upper ends of the tiles 12 in the row 24 and are nailed in place on the roof support structure 14, as shown in FIG. 3. A separate moisture frame 36 is mounted in each of the apertures 32. Each moisture frame 36 is comprised of a hollow, circular base 38 for seating in the aperture 32 and a hollow, circular collar 40 extending upwardly from the base 38 on the opposite side of a flange 42 which is seated on the roof support structure 14. It is virtually impossible to prevent some moisture from reaching the upper surface of the roof support structure 14, even with the best of moisture sealing techniques. Should moisture accumulate on the roof support structure 14, the collar 40 and the flange 42 of each moisture frame 36 extends upwardly from the roof support structure 14 to prevent the moisture from entering the apertures 32.

Figure 4:
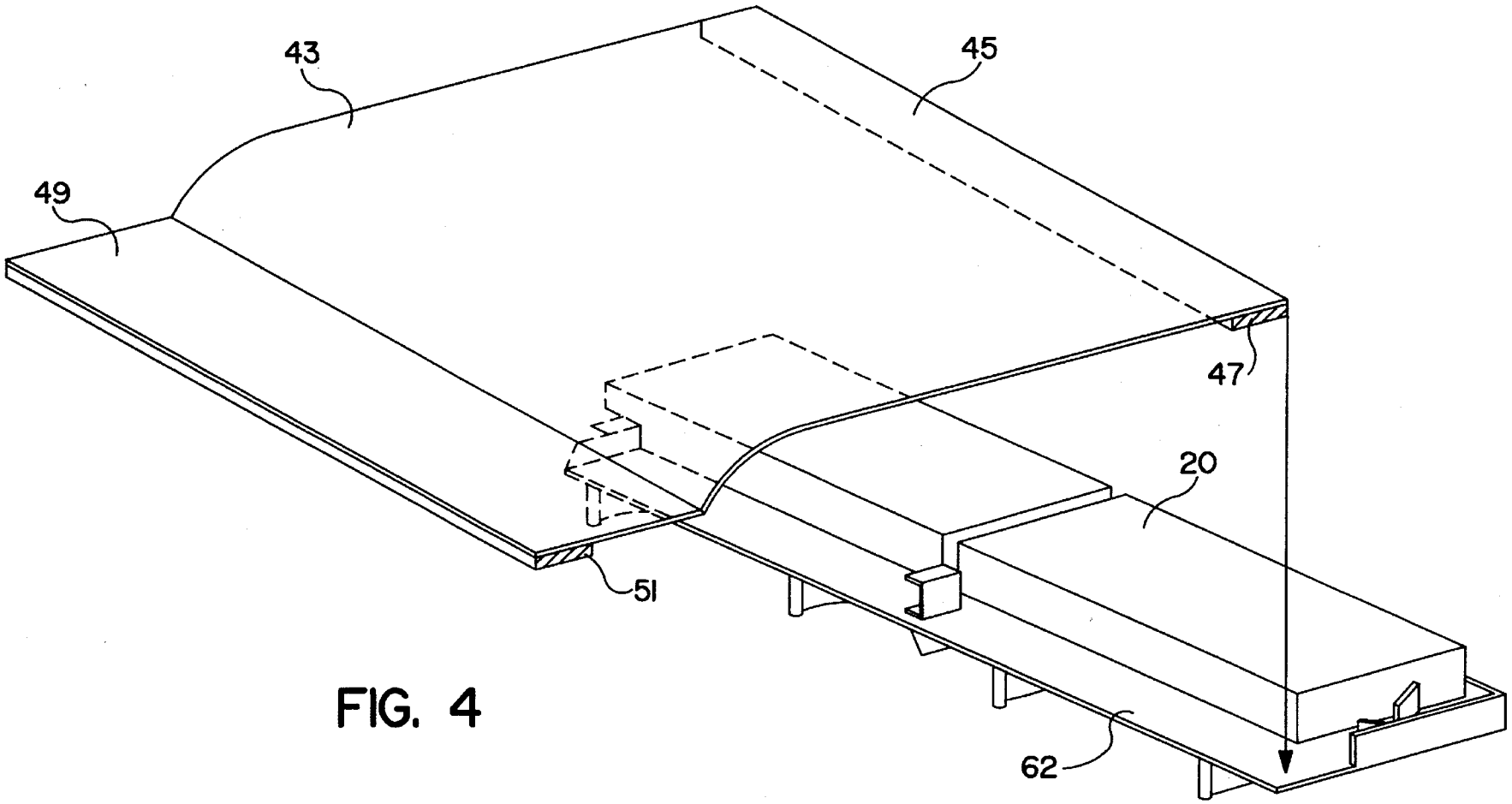
FIG. 4 is a perspective view of the moisture tray of FIG. 3, showing the manner in which it is joined to the rear portion of the roof ventilation device.
Figure 5:
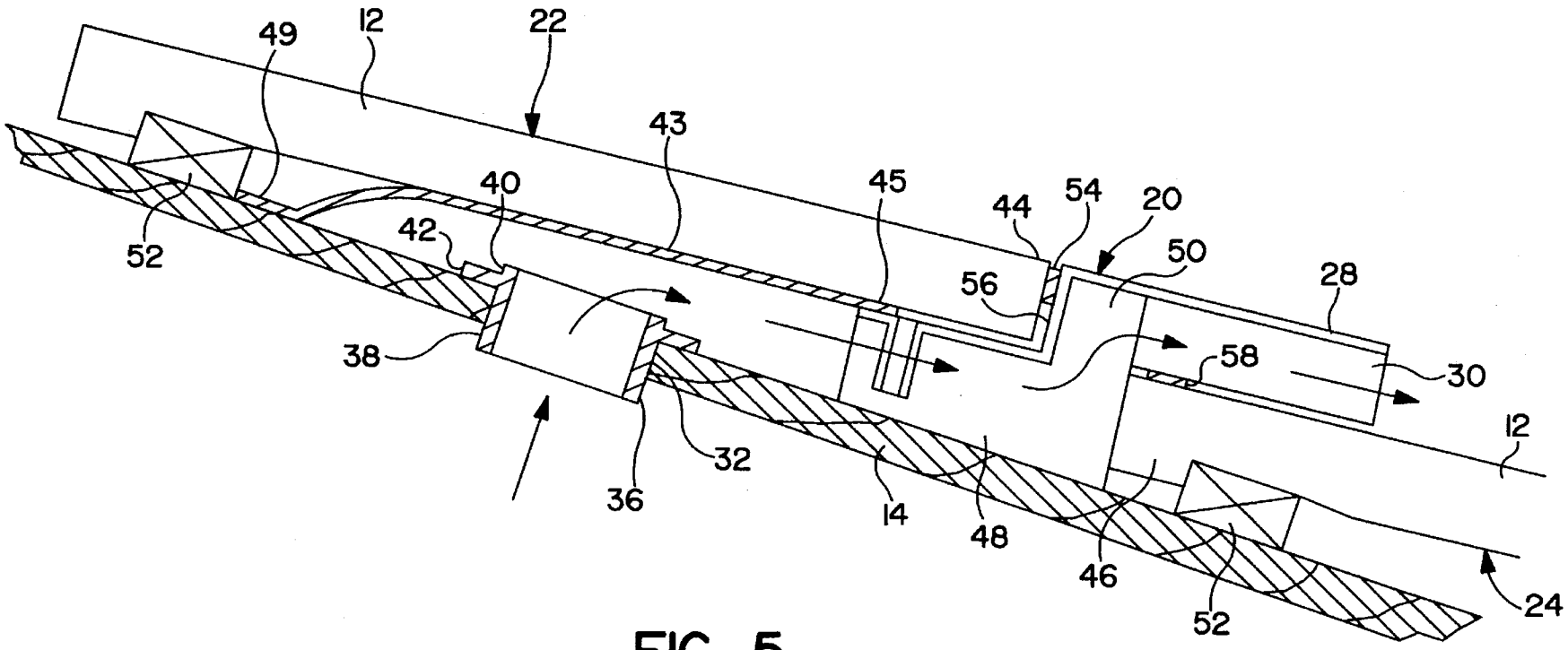
FIG. 5 is a side sectional view of a portion of the roof structure of FIG. 1 taken along the line 5—5 thereof and showing the manner in which the roof ventilation devices ventilate the underside of the roof support structure to the atmosphere above the roof structure.

To provide further sealing so that moisture does not accumulate on the roof support structure 14, a separate moisture tray 43 is joined to each roof ventilation device 20 so as to extend over the two apertures 32 therebelow. As shown in FIG. 3, the moisture trays 43 are installed over the collars 40 and onto the roof ventilation devices 20, after the roof ventilation devices 20 are installed on the roof support structure 14 but before the first row 22 of the tiles 12 are installed. As shown in FIGS. 4 and 5, the moisture trays 43 are of generally planar but slightly curved configuration so that a substantial portion of the length thereof conforms to the undersides of the tiles 12 in the first row 22. Each moisture tray 43 has a forward edge 45 provided with a strip of adhesive 47 at the underside thereof to facilitate securing the edge 45 to the roof ventilation device 20. An opposite rear edge 49 of the moisture tray 43 is also provided with a strip of adhesive 51 at the underside thereof to facilitate securing to the roof support structure 14.

FIG. 5 is a sectional view of a portion of the roof structure 10 of FIG. 1 taken along the line 5—5 of FIG. 1. As shown in FIG. 5, the hollow upper portion 28 of the roof ventilation device 20 is generally continuous with and extends forwardly from a lower edge 44 of the tile 12 within the upper row 22, so as to combine with the shortened tile 12 within the upper row 22 to form a structure having a length equal to the standard length of the tiles 12 in the other rows such as the next lower row 24. As such, the hollow upper portion 28 extends over an upper portion 46 of the tiles 12 within the next lower row 24 in the same manner that the tiles 12 within the other rows of the roof structure 10 overlap the upper portions of the tiles within the row immediately therebelow. The hollow upper portion 28 also forms a portion of a ventilation path which extends from the underside of the roof support structure 14 to the atmosphere outside of and above the roof structure 10. From the attic space beneath the roof support structure 14, the ventilation path extends through the moisture collar 36 to the space beneath the tile 12 in the upper row 22. From there, the ventilation path extends between a plurality of spaced apart legs 48 of the roof ventilation device 20 to an inside portion 50 at the back of the hollow upper portion 28. From there, the ventilation path extends through the hollow upper portion 28 and past the baffles 30 thereof to the atmosphere outside of and above the roof structure 10.

In FIG. 5, the tiles 12 in the rows 22 and 24 thereof are shown mounted on battens 52 secured to the upper surface of the roof support structure 14. As previously noted in connection with FIG. 1, the tiles 12 can be mounted on the roof support structure 14 with or without battens. The battens 52 are shown in FIG. 5 for convenience of illustration.

As shown in FIG. 5, the legs 48 at the underside of the roof ventilation device 20 extend downwardly and into contact with the top of the roof support structure 14 to mount the roof ventilation device 20 thereon. At the same time, the legs 48 extend forwardly into contact with the upper edges 46 of the tiles 12 within the next lower row 24 so as to position the roof ventilation device 20 in a desired manner relative to the tiles 12 within the next lower row 24. The lower edge 44 of the tile 12 in the upper row 22 contacts a foam strip 54 on a back surface 56 of the hollow upper portion 28 of the roof ventilation device 20. This prevents water from flowing into the space between the lower edge 44 and the back surface 56. A foam strip 58 mounted on the underside of hollow upper portion 28 seals the space between the underside of the hollow upper portion 28 and the upper surface of the tiles 12 in the lower row 24. The upper surfaces of the tiles 12 tend to be slightly rounded as well as irregular, and the foam strip 58 allows for this.

As also shown in FIG. 5, the moisture tray 43 is disposed in contact with the undersides of the tiles 12 in the first row 22 thereof along most of the lengths of the moisture trays 43 and the tiles 12. The forward edge 45 is secured onto the roof ventilation device 20 by the adhesive strip 47, while the opposite rear edge 49 is secured onto the roof support structure 14 by the adhesive strip 51. The moisture tray 43, which may be made of plastic, metal, or other moisture-impervious material, prevents moisture from leaking or otherwise passing through the tiles 12 in the first row 22 to the roof support structure 14 in the region of the apertures 32 therein.

As previously noted in connection with FIG. 1, the hollow upper portions 28 of the roof ventilation devices 20 have a plurality of baffles 30 mounted therein to provide a rain barrier. As described in detail hereafter, the baffles 30 function in a unique and effective manner to prevent wind driven rain from reaching the inside portion 50 at the back of the hollow upper portion 28. As also described hereafter, the bottom of the inside portion 50 is provided with a length of mesh, which acts as a bug screen to prevent bugs, vermin and other debris from entering the space between the legs 48 and thereby the apertures 32 within the roof support structure 14.

While the roof support structure 14 can be provided with an arrangement of the apertures 32 of any appropriate number and having any appropriate size, it is preferred that the areas of the apertures 32 be approximately equal to the areas of the front ends of the hollow upper portions 28 of the roof ventilation devices 20. This provides a relatively uniform ventilation path through the roof structure 10 between the outside of the roof structure 10 and the underside of the roof support structure 14.

Figure 6:
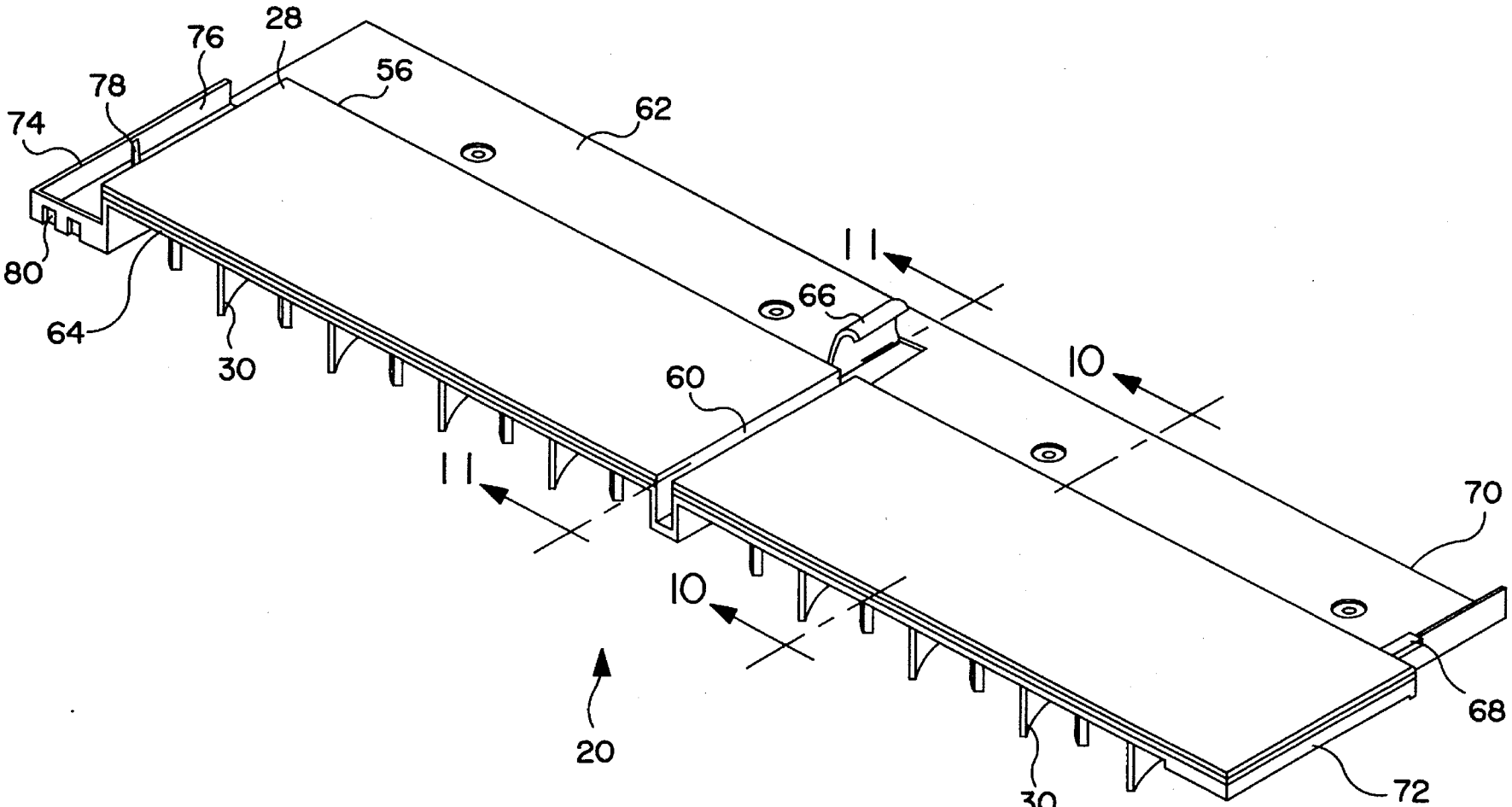
FIG. 6 is a right-front perspective view of one of the roof ventilation devices of FIG. 1.

FIG. 6 is a right-front perspective view of the roof ventilation device 20. As shown in FIG. 6, the roof ventilation device 20 is of elongated configuration and has a central slot 60 therein. The central slot 60, which extends from the back surface 56 of the hollow upper portion 28 at the front of a rear portion 62 to a front edge 64 of the roof ventilation device 20, serves as a water drain for moisture which may collect at the rear portion 62. Such moisture flows along the central slot 60 to the front edge 64 where it empties onto the upper portions 46 of the tiles 12 within the next lower row 24. The central slot 60 divides the hollow upper portion 28 of the roof ventilation device 20 into opposite halves of approximately equal length.

As shown in FIG. 6, the rear portion 62 of the roof ventilation device 20 has a pair of clips 66 and 68 extending upwardly therefrom. The clip 66 which extends upwardly from an intermediate portion of the length of the rear portion 62 extends over and engages a side edge of one of the shortened tiles 12 within the upper row 22 which is received and secured onto the rear portion 62. The other clip 68 which is disposed at an end 70 of the rear portion 62 extends over and engages the side edge of a tile 12 within the upper row 22 adjacent the tile engaged by the clip 66. In this manner, the clips 66 and 68 extend over and engage the side edges of the shortened tiles within the upper row 22 so as to secure the lower edges 44 of such tiles on the rear portion 62 of the roof ventilation device 20. At the same time, the various tiles 12 within the upper row 22 have overlapping side edges in conventional fashion, as do the various tiles 12 within the other rows of the roof structure 10.

The clip 68 is mounted at the end 70 of the rear portion 62 which is adjacent a first end 72 of the roof ventilation device 20. The device 20 has an opposite second end 74 configured to form an upwardly facing slot 76 having angled vanes 78 therein. The slot 76 is capable of receiving a portion of the side edge of one of the tiles 12 of the uppermost row 22, in the case where another roof ventilation device 20 is not mounted at the second end 74. In that event, such tile is of standard length and the side edge of the lowermost portion thereof resides within the slot 76. However, where a plurality of the roof ventilation devices 20 are mounted end-to-end, as shown in FIG. 1, then the first end 72 of an adjacent roof ventilation device 20 overlaps and fits onto the second end 74 of the roof ventilation device 20 shown in FIG. 6. A forward edge of the second end 74 is provided with apertures 80 for draining moisture which may accumulate within the slot 76.

Figure 7:
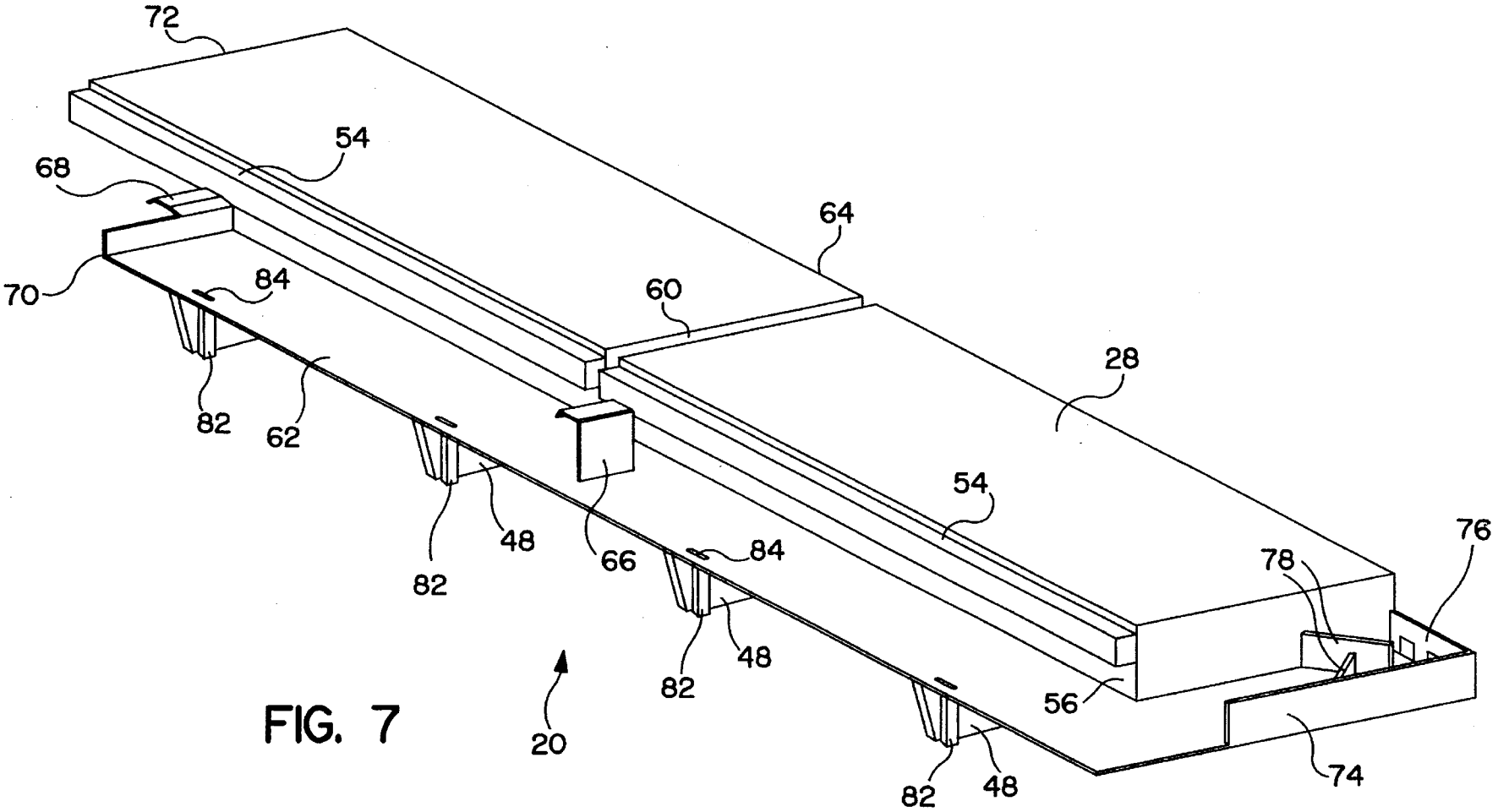
FIG. 7 is a left-rear perspective view of the roof ventilation device of FIG. 6.

FIG. 7 is a left-rear perspective view of the roof ventilation device 20 which shows the rear portion 62 thereof in greater detail. As shown in FIG. 7, the rear portion 62 is of relatively thin, generally planar configuration and extends rearwardly from the surface 56 of the hollow upper portion 28 of the roof ventilation device 20. The rear portion 62 extends around the hollow upper portion 28 at the second end 74 so as to form the slot 76 thereat. The clip 66 extends upwardly from an intermediate portion of the length of the rear portion 62 as shown. As also shown in FIG. 7, the clip 68 is of hook-shaped configuration, as is the clip 66, and extends outwardly from the end 70 of the rear portion 61. The clips 66 and 68 are configured so as to extend over and conform to grooves in the side edges of the tiles 12 within the upper row 22, as previously described.

As shown in FIG. 7, the roof ventilation device 20 includes four of the legs 48. Each of the legs 48 has a thickened portion 82 thereof to accommodate a nail hole 84 extending to the bottom of the leg 48 from the rear portion 62. Nails are inserted into the nail holes 84 in the rear portion 62 and then driven into the roof support structure 14 below the bottom edges of the legs 48 to mount the roof ventilation device 20 on the roof support structure 14.

Figure 8:
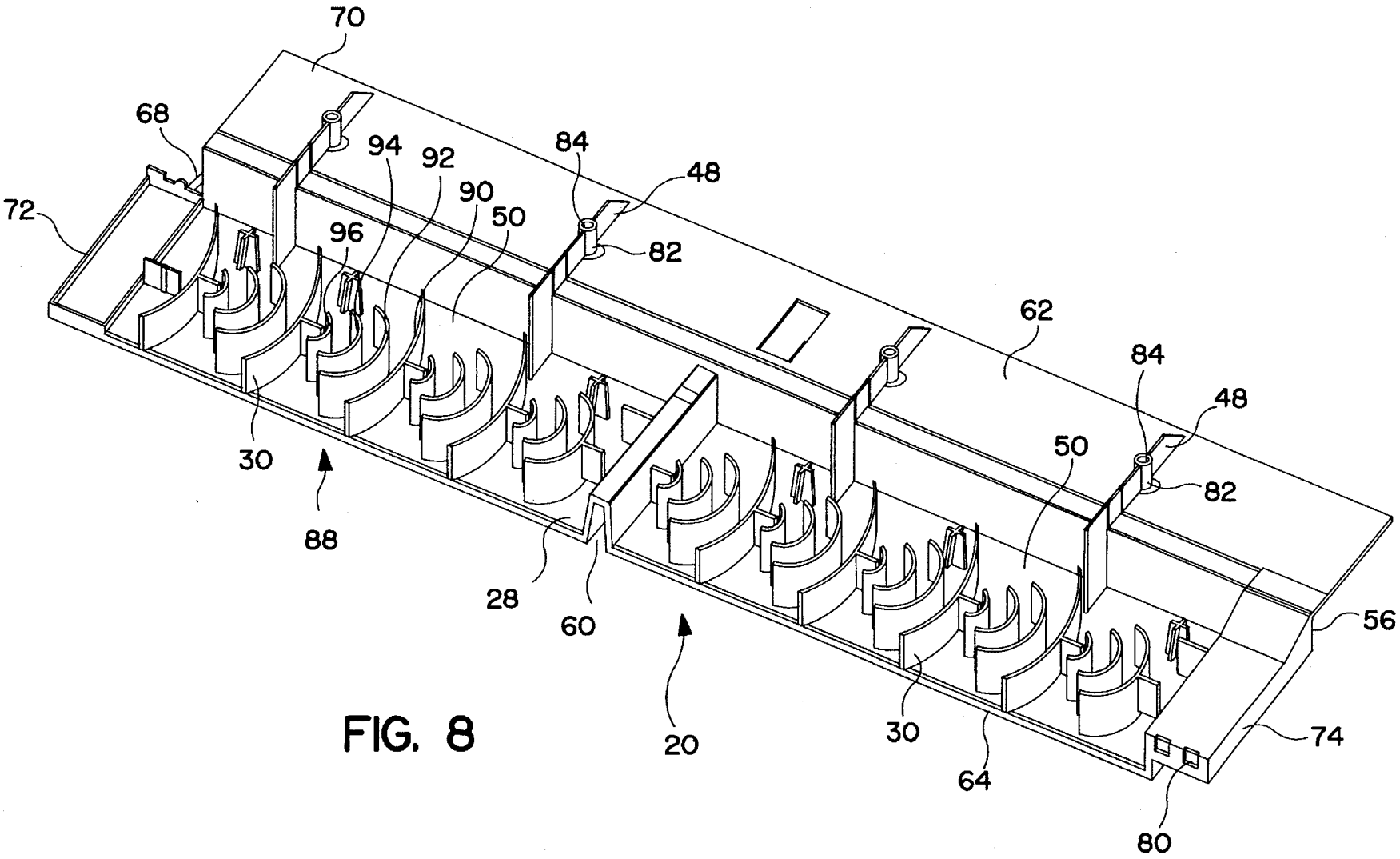
FIG. 8 is a perspective view of the roof ventilation device of FIG. 6 with the mesh and associated foam strips removed to show the details of the repeating baffle pattern.
Figure 9:
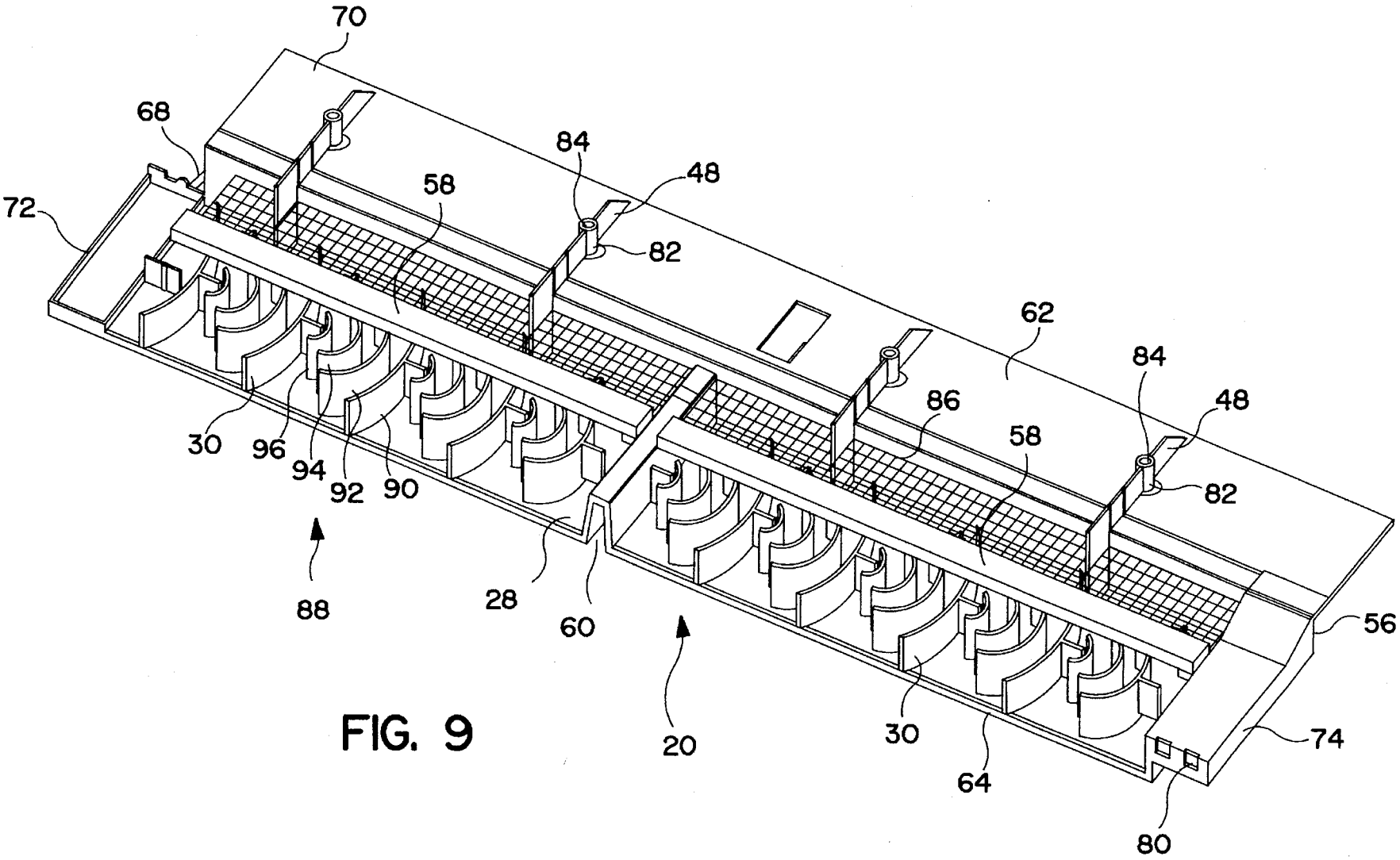
FIG. 9 is a perspective view like that of FIG. 8 but with the mesh and the associated foam strips in place.
Figure 10:
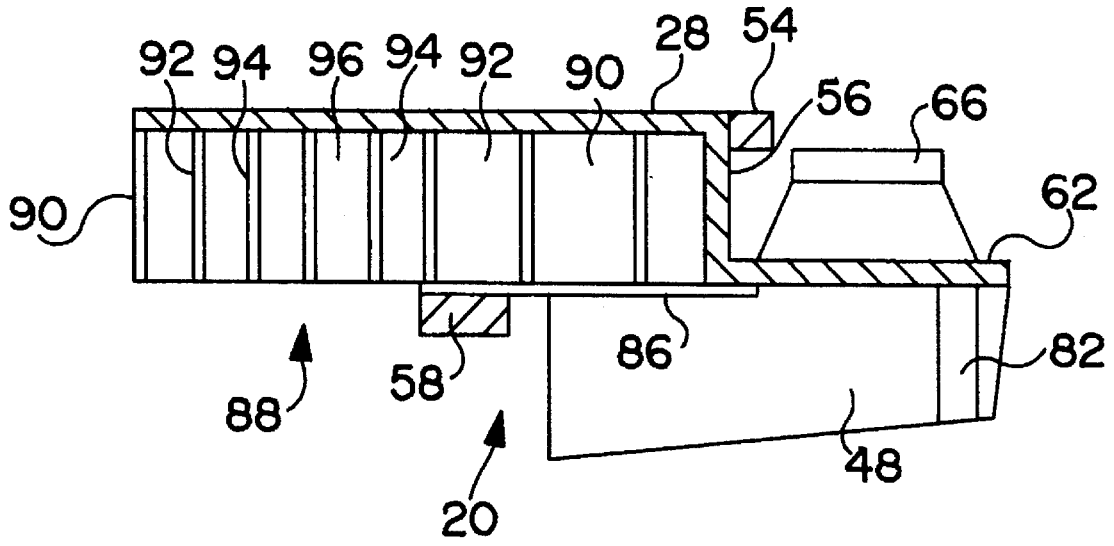
FIG. 10 is a sectional view of the roof ventilation device of FIG. 6 taken along the line 10—10 of FIG. 6.
Figure 11:
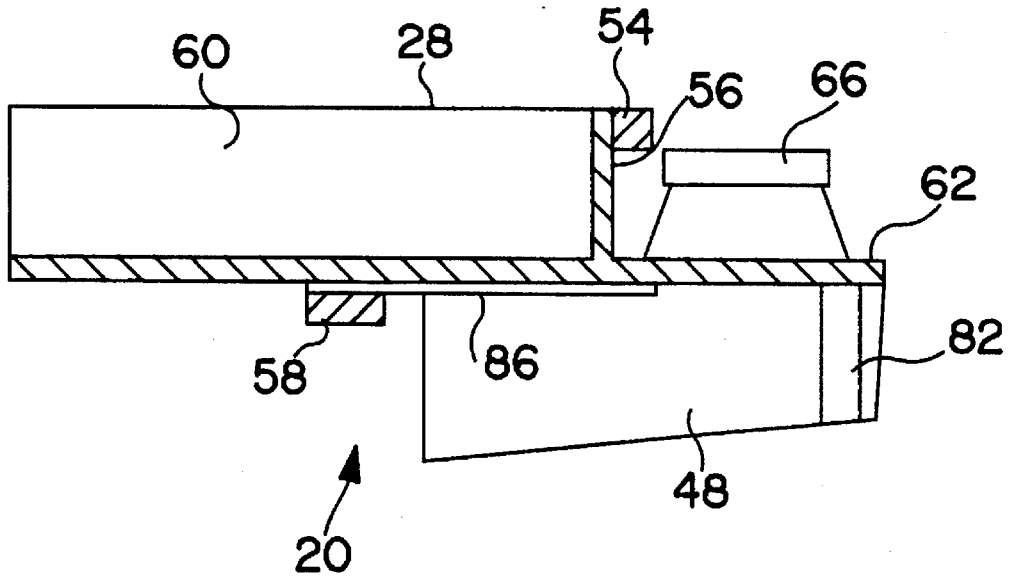
FIG. 11 is a sectional view of the roof ventilation device of FIG. 6 taken along the line 11—11 of FIG. 6.

FIG. 8 is a lower perspective view of the roof ventilation device 20 with the foam strips 58 and a length of mesh removed to show the baffles 30 in detail. FIG. 9 is the same view as FIG. 8, but with the foam strips 58 and a length of mesh 86 in place. FIG. 10 is a sectional view of the roof ventilation device 20 taken along the line 10—10 of FIG. 6, while FIG. 11 is a sectional view of the roof ventilation device 20 taken along the line 11—11 of FIG. 6.

As shown in FIG. 8, the baffles 30 comprise a repeating pattern of curved, arc shaped vanes mounted along the length of the upper portion 28 of the roof ventilation device 20. The vanes are of decreasing curvature and increasing length, within each pattern.

As shown in FIG. 8, the repeating portion of the pattern of baffles 30 is comprised of a group 88 of vanes. The group 88 includes a first vane 90 having the greatest length and the least curvature of a plurality of vanes comprising the group 88. The first vane 90 extends from the front edge 64 all the way to the inside portion 50 at the back of the hollow upper portion 28. The group 88 of vanes includes a second vane 92 of smaller length and greater curvature than the first vane 90. As shown in FIG. 8, the second vane 92 extends from a position inside of the front edge 64 to a position spaced apart from the beginning of the inside portion 50. The group 88 of vanes includes a third vane 94 disposed on the other side of the second vane 92 from the first vane 90. The third vane 44 is smaller in length and of greater curvature than the second vane 92. The group 88 of vanes includes a fourth vane 96 disposed on the opposite side of the third vane 94 from the second vane 92. The fourth vane 92 is smaller in length and greater in curvature than the third vane 94.

As shown in FIG. 8, the vane group 88 comprised of the first, second, third and fourth vanes 90, 92, 94 and 96 repeats in pattern fashion along the length of the hollow upper portion 28. The various vanes 90, 92, 94 and 96 are of like height so as to extend from the top of the hollow upper portion 28 to a region adjacent the upper surfaces of the tiles 12 within the next lower row 24.

The vane groups 88 prevent rain from reaching the inside portion 50. The varying size and curvature of the repeating vane patterns act to prevent even horizontally wind driven rain, such as might be encountered in the case of gale force winds or hurricane conditions, from reaching the inside portion 50.

As shown in FIG. 9, a length of mesh 86 is mounted at the bottom of the inside portion 50 along the entire length of the inside portion 50. The length of mesh 86 extends around the legs 48 and is secured to the inner edges of the vane groups 88. The mesh 86 is also secured to the underside of the rear portion 62. The mesh 86 functions as a bug screen. Should insects, vermin or other debris somehow enter the hollow upper portion 28 and pass by the baffles 30 so as to reach the inside portion 50, the mesh 86 prevents such insects, vermin or debris from passing through the spaces between the legs 48 to the roof support structure 14 therebelow.

The foam strips 58 are mounted along an edge of the mesh 86 adjacent the vane groups 88, as shown in FIG. 9. As previously noted, the foam strips 58 reside over the upper surfaces of the tiles 12 in the lower row 24 when the roof ventilation device 20 is mounted in place thereon. The foam strips 58 seal the space between the underside of the hollow upper portion 28 of the roof ventilation device 20 and the upper surfaces of the tiles 12 which tend to be irregular and slightly curved.

The roof ventilation device 20 shown and described in connection with FIGS. 1–11 is of relatively flat, generally planar configuration for use with the relatively flat concrete roof tiles 12. However, the same principles apply in the case of profiled tiles which are of curved cross-sectional configuration. In the case of profiled tiles, the roof ventilation devices are configured to conform to the profiled shapes of such tiles. An example is shown in FIGS. 12–14.

Figure 12:
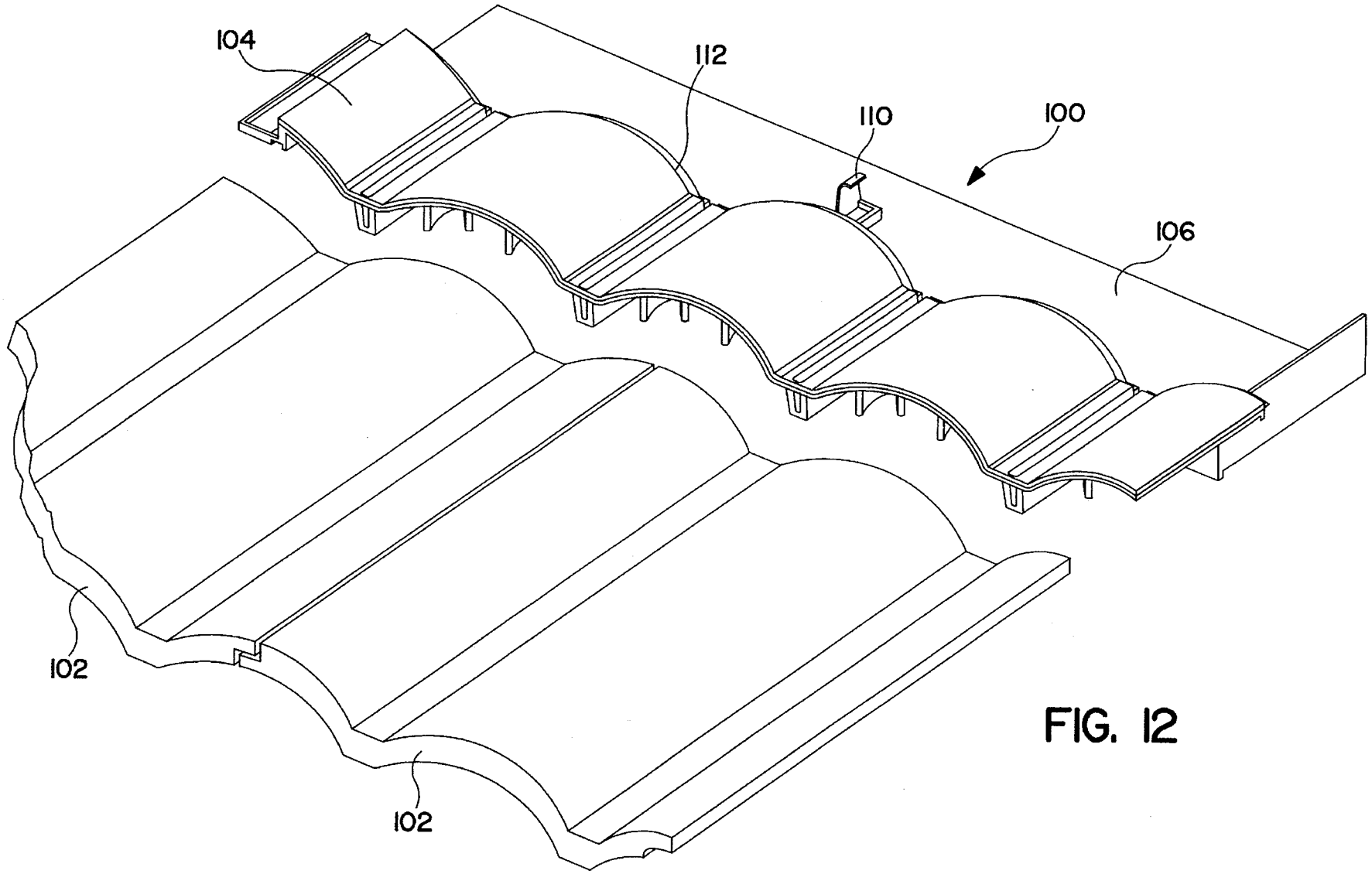
FIG. 12 is a perspective view of a roof ventilation device in accordance with the invention which is similar to the device of FIGS. 1–11 but which is configured to conform to profiled tiles shown therein.
Figure 13:
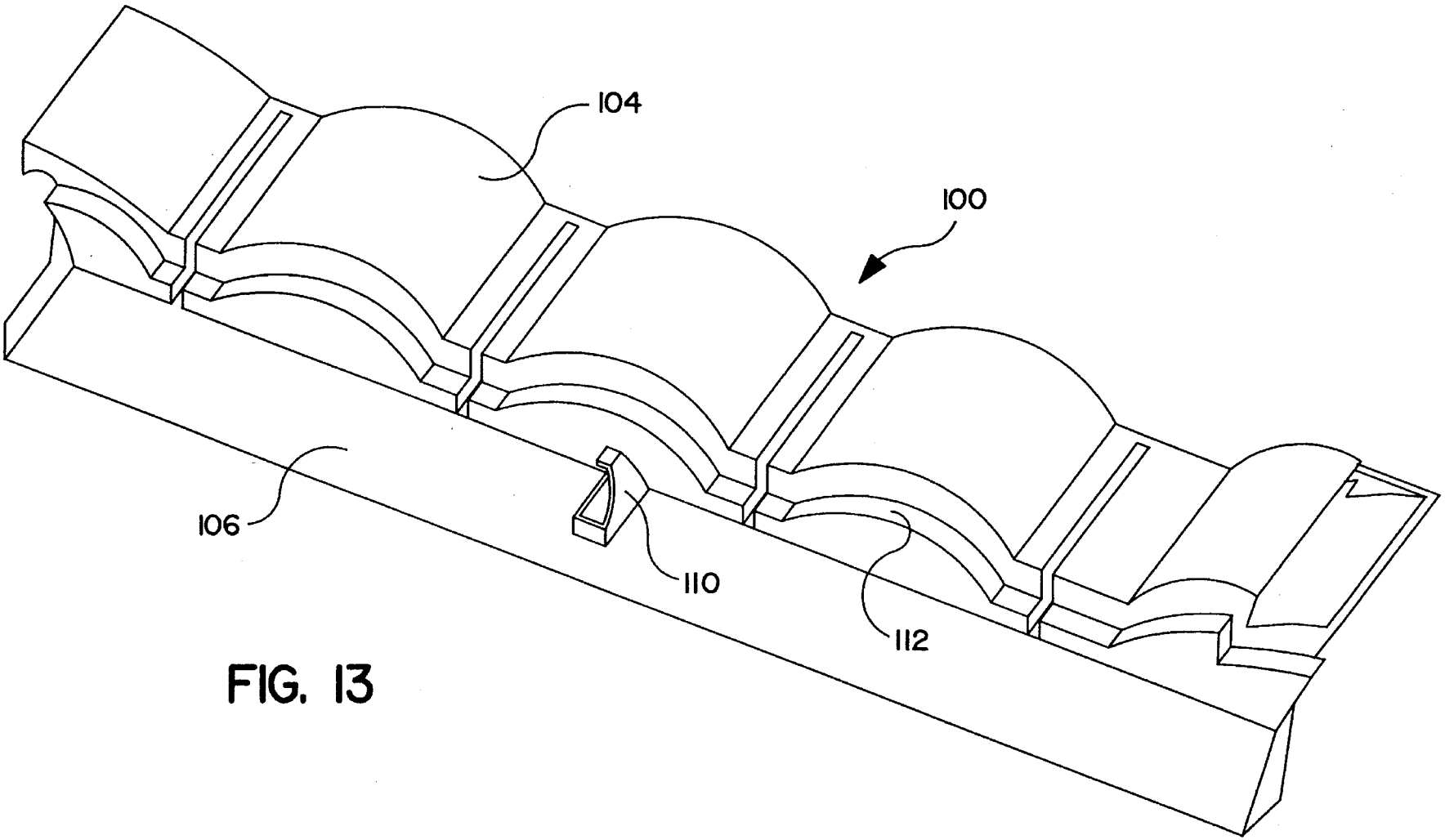
FIG. 13 is a rear perspective view of the roof ventilation device of FIG. 12.
Figure 14:
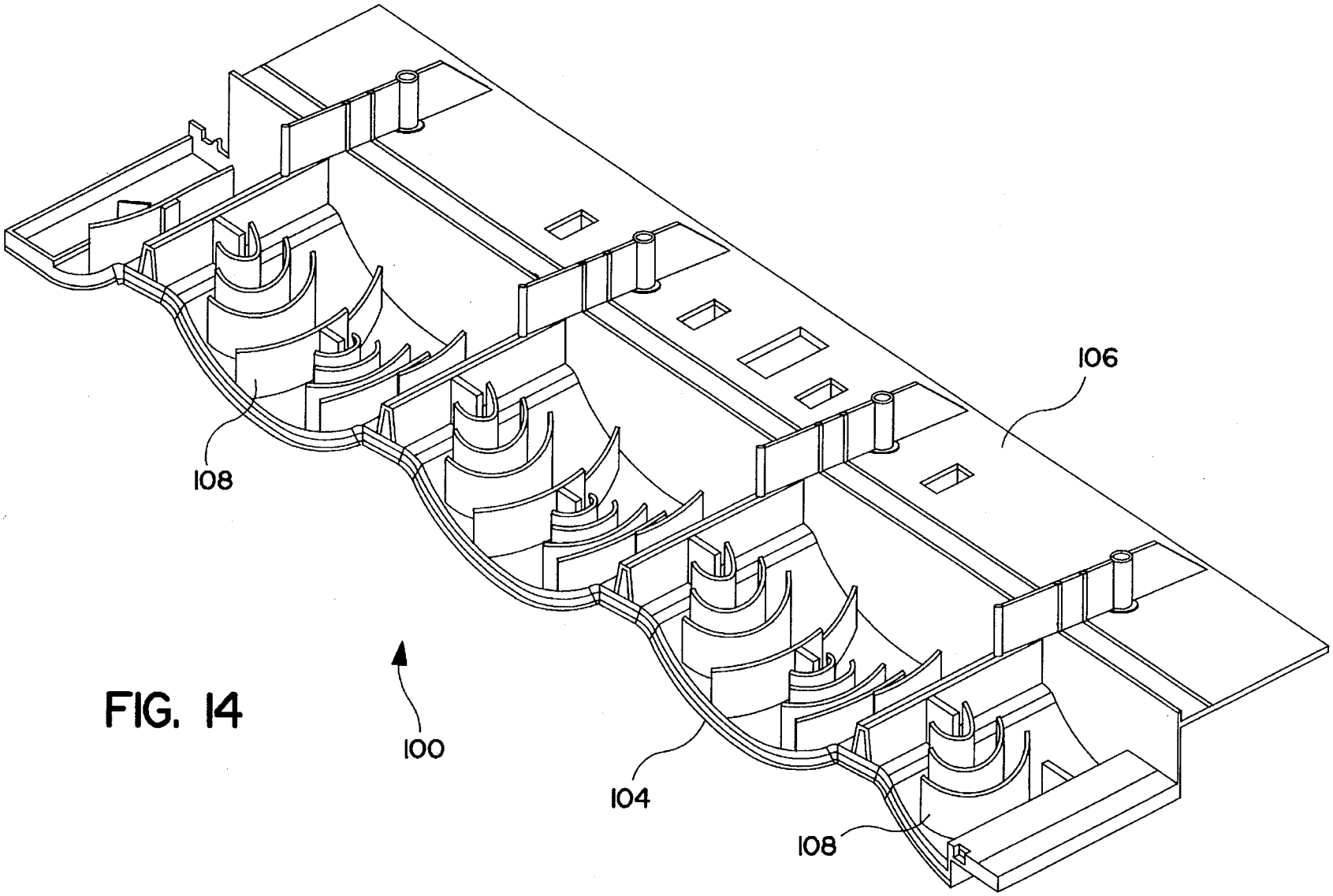
FIG. 14 is an underside perspective view of the roof ventilation device of FIG. 12 with the mesh and associated foam strips removed to show the details of the repeating baffle pattern.

Referring to FIGS. 12–14, a roof ventilation device 100 which is designed for use with profiled concrete roof tiles is shown. Several profiled concrete roof tiles 102 are shown in FIG. 12. As in the case of the roof ventilation device 20 of FIGS. 1–11, the device 100 of FIGS. 12–14 has a hollow upper portion 104 and a rear portion 106. Whereas the rear portion 106 is flat, as in the case of the device 20 of FIGS. 1–11, the hollow upper portion 104 is of curved, undulating configuration so as to conform to the profiled tiles 102 shown in FIG. 12. The hollow upper portion 104 is provided with a repeating baffle pattern comprised of groups of vanes 108 having decreasing curvature and increasing length, as in the case of the device 20 of FIGS. 1–11. The vanes 108 are of like height so as to extend downwardly to locations adjacent the curved upper surface of the tiles 102. While not shown in FIG. 14 for simplicity of illustration, the device 100 is provided with a length of mesh and foam strips, which are similar to the foam strips 58 and the mesh 86 of FIG. 9 except that they are curved in the manner of the hollow upper portion 104 of the roof ventilation device 100. Consequently, the foam strips seal the space between the bottom edges of the vanes 108 and the curved upper surface of the tiles 102.

As shown in FIGS. 12 and 13, the rear portion 106 of the roof ventilation device 100 is provided with a clip 110 which engages the side edge of a shortened upper concrete tile installed thereover. At the same time, the upper concrete tiles are supported by a ledge 112 extending outwardly from the back of the upper portion 104. In this manner, the rear portion 106 of the roof ventilation device 100 can be made flat and still accommodate tiles of profiled cross-sectional configuration.

The roof ventilation devices 20 and 100 can be made of any appropriate material such as plastic or metal. However, a preferred material for use in construction of the devices 20 and 100 is sold under the trademark "Noryl" by General Electric Company. Roof ventilation devices made of such material are capable of achieving a Class "A" fire rating, in accordance with Standard No. 32-7 of the Uniform Building Code. Such devices also comply with Standard No. 790 of Underwriters Laboratories Inc.

While the invention has been particularly shown and described with reference to preferred embodiments thereof, it will be understood by those skilled in the art that various changes in form and details may be made therein without departing from the spirit and scope of the invention.

We claim:

1. A roof structure comprising the combination of:

a roof support structure;

a plurality of rows of tiles mounted on the support structure, with each of the rows being mounted above an adjacent lower row so that adjacent rows are spaced apart by a generally like distance; and at least one roof ventilation device disposed between at least one tile in a first row of the plurality of rows and at least one tile in a second row of the plurality of rows which is adjacent and immediately below the first row, the at least one tile in the first row having an upper surface and the roof ventilation device having a portion thereof extending from and having an upper surface generally continuous with the upper surface of the at least one tile in the first row and forming an extension of the at least one tile in the first row, the roof ventilation device forming a ventilation path between the at least one tile in the first row and the at least one tile in the second row, which path extends to the roof support structure.

2. The invention set forth in claim 1, wherein the roof support structure has an aperture therein beneath the at least one tile in the first row.

3. The invention set forth in claim 2, wherein the aperture is circular, and further including a moisture frame mounted therein and having a circular collar extending above the roof support structure.

4. The invention set forth in claim 1, further including a moisture tray disposed beneath and adjacent the at least one tile in a first row and extending between the roof ventilation device at a forward edge thereof and the roof support structure at a rear edge thereof.

5. The invention set forth in claim 1, wherein the plurality of rows of tiles are comprised of tiles of like length except for the first row in which the at least one tile thereof has a length shorter than the like length and terminates in a lower edge which is secured on the roof ventilation device, the portion of the roof ventilation device being generally continuous with and extending from the lower edge of the at least one tile of the first row to form an extension which combines with the shorter length of the at least one tile to approximately equal the like length.

6. The invention set forth in claim 5, wherein the roof ventilation device has a plurality of spaced apart legs at an underside thereof which extend to the roof support structure beneath the lower edge of the at least one tile of the first row and extend into contact with an upper edge of the at least one tile of the second row.

7. The invention set forth in claim 6, wherein the portion of the roof ventilation device comprises an upper portion opposite the underside thereof which is generally continuous with the at least one tile of the first row and forms a portion of the ventilation path above the upper edge of the at least one tile of the second row.

8. The invention set forth in claim 7, wherein the upper portion of the roof ventilation device has an inside portion thereof above the upper edge of the at least one tile of the second row which opens to spaces between the plurality of spaced apart legs to form a portion of the ventilation path.

9. The invention set forth in claim 8, wherein the upper portion of the roof ventilation device has a plurality of vanes therein for preventing rain water from being driven through the upper portion to the inside portion thereof.

10. The invention set forth in claim 9, wherein the roof ventilation device includes a length of mesh mounted within the inside portion and forming an insect barrier.

11. A roof structure comprising the combination of:

an upper tile having an upper surface and a lower edge;

a lower tile having an upper edge adjacent the lower edge of the upper tile; and a roof ventilation device having a rear portion for securing the upper tile thereon, a hollow upper portion extending from the lower edge of the upper tile over the upper edge of the lower tile and having an upper surface generally continuous with the upper surface of the upper tile, the hollow upper portion forming a portion of a ventilation path, and a leg portion extending downwardly from the rear portion and into contact with the upper edge of the lower tile and forming a portion of the ventilation path.

12. The invention set forth in claim 11, wherein the rear portion of the roof ventilation device includes a clip extending over a side edge of the upper tile adjacent the lower edge of the upper tile to secure the upper tile thereon.

13. The invention set forth in claim 11, further including a second upper tile having a lower edge received on the rear portion of the roof ventilation device.

14. The invention set forth in claim 13, further including a third upper tile disposed on an opposite side of the first-mentioned upper tile from the second upper tile and having a side edge, and wherein the rear portion of the roof ventilation device has a second clip at an end thereof extending over the side edge of the third upper tile.

15. The invention set forth in claim 14, wherein the first-mentioned upper tile and the second and third upper tiles have overlapping side edges.

16. The invention set forth in claim 11, further including a second lower tile disposed adjacent the first-mentioned lower tile and having an upper edge, and wherein the upper portion of the roof ventilation device extends over the upper edge of the second lower tile and the leg portion of the roof ventilation device extends into contact with the upper edge of the second lower tile.

17. A roof ventilation device comprising the combination of:

a rear portion having an upper surface thereof;

a hollow upper portion extending forwardly from the rear portion and having a back surface thereof extending upwardly from the upper surface of the rear portion to an upper surface thereof, the upper surface thereof extending forwardly from the back surface thereof, the upper surface of the rear portion and the back surface of the hollow upper portion receiving a lower edge of at least one upper tile;

a plurality of spaced apart legs extending downwardly from the rear portion and part of the upper portion; and a plurality of baffles disposed within the hollow upper portion to form a rain barrier;

the baffles comprising a repeating pattern of arc shaped vanes along a length of the upper portion, the pattern comprising a plurality of arc shaped vanes of decreasing curvature and increasing length.

18. A roof ventilation device comprising the combination of:

a rear portion having an upper surface thereof;

a hollow upper portion extending forwardly from the rear portion and having a back surface thereof extending upwardly from the upper surface of the rear portion to an upper surface thereof, the upper surface thereof extending forwardly from the back surface thereof, the upper surface of the rear portion and the back surface of the hollow upper portion receiving a lower edge of at least one upper tile; and a plurality of spaced apart legs extending downwardly from the rear portion and part of the upper portion;

the rear portion including at least one clip for engaging the at least one upper tile.

19. The invention set forth in claim 18, wherein the rear portion includes a second clip for engaging a second upper tile, the second clip being disposed at an end of the rear portion.

* * * * *